US008348689B2

(12) United States Patent
Shibata

(10) Patent No.: US 8,348,689 B2
(45) **Date of Patent: *Jan. 8, 2013**

(54) CONNECTOR AND CONNECTOR ASSEMBLY

(75) Inventor: Takahiro Shibata, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 33 days.

This patent is subject to a terminal disclaimer.

(21) Appl. No.: 13/104,065

(22) Filed: May 10, 2011

(65) Prior Publication Data

US 2011/0286786 A1 Nov. 24, 2011

(30) Foreign Application Priority Data

May 24, 2010 (JP) ..... 2010-118652

(51) Int. Cl.
*H01R 13/52* (2006.01)

(52) U.S. Cl. ..... 439/271; 174/153 G

(58) Field of Classification Search ..... 439/251, 439/272, 277, 278, 587, 559, 89; 174/153 G
See application file for complete search history.

(56) References Cited

U.S. PATENT DOCUMENTS

| | | | | |
|---|---|---|---|---|
| 4,998,896 | A * | 3/1991 | Lundergan | 439/595 |
| 5,151,045 | A * | 9/1992 | Cravens et al. | 439/271 |
| 5,201,625 | A | 4/1993 | Takenouchi et al. | |
| 5,743,756 | A * | 4/1998 | Hasz et al. | 439/364 |
| 5,871,373 | A * | 2/1999 | Pacini et al. | 439/587 |
| 7,029,328 | B1 * | 4/2006 | Mckenzie et al. | 439/587 |
| 7,104,840 | B2 * | 9/2006 | Murakami | 439/587 |
| 2002/0076980 | A1 | 6/2002 | Ishikawa et al. | |

FOREIGN PATENT DOCUMENTS

| | | |
|---|---|---|
| DE | 20004565 U1 | 7/2000 |
| JP | 2002-231405 | 8/2002 |

* cited by examiner

*Primary Examiner* — Edwin A. Leon
*Assistant Examiner* — Harshad Patel
(74) *Attorney, Agent, or Firm* — Gerald E. Hespos; Michael J. Porco

(57) ABSTRACT

A recess (67) is formed in a connection surface of a housing. A nut (52) is inserted into the recess (67) and fixed to the housing in a state exposed on the connection surface. A sealing material is introduced into the recess (67), and the outer peripheral surface of the nut (52) is coated with the sealing material. The recess (67) of the housing includes a first surface (71) arranged to face the outer peripheral surface of the nut (52) while forming an introduction space (74) for the sealing material between itself and the outer peripheral surface of the nut (52), a second surface (72) arranged to project radially outwardly from the opening edge of the first surface (71) and a third surface (73) arranged from the outer end of the second surface (72) to the connection surface in a direction crossing a projecting direction of the second surface (72).

10 Claims, 8 Drawing Sheets

CONNECTOR AND CONNECTOR ASSEMBLY

BACKGROUND OF THE INVENTION

1. Field of the Invention

The invention relates to a connector and a connector assembly.

2. Description of the Related Art

Japanese Unexamined Patent Publication No. 2002-231405 discloses a conventional connector with a housing connectable to a mating housing and terminal fittings mounted in the housing. A recess is formed in the front surface (connection surface) of the housing, and the terminal fittings project forward from the center of the recess. A sealing material is introduced into the recess, so that the outer peripheral surfaces of the terminal fittings are coated with the sealing material. The entire inner surface of the recess is curved surface and the sealing material is introduced until the surface thereof is located very close to the opening edge of the recess.

Since the surface position of the introduced sealing material is specified using the opening edge of the recess substantially as a mark in the above conventional construction, the sealing material tends to leak out from the opening edge of the recess and adhere to the connection surface. Thus, the introduced amount of the sealing material has to be strictly managed, which might deteriorate operability when introducing the sealing material. This type of problem becomes apparent when introducing a sealing material around a nut when two housings are connected by tightening a bolt and a nut.

The present invention was developed in view of the above situation and an object thereof is to improve operability at the time of introducing a sealing material around a nut.

SUMMARY OF THE INVENTION

The invention relates to a connector with a housing that is connectable to a mating housing. At least one recess is formed in a connection surface of the housing that faces the mating housing in a connected state. At least one nut is inserted into the recess and is fixed to the housing in a state at least partly exposed on the connection surface. The nut is threadedly engageable with at least one bolt mounted in the mating housing to hold the housings in the connected state. A sealing material is introduced into the recess and the outer peripheral surface of the nut is coated with the sealing material. The recess of the housing includes a first surface that faces the outer peripheral surface of the nut while forming an introduction space for the sealing material between first surface and the outer peripheral surface of the nut. A second surface projects radially out from the opening edge of the first surface and a third surface is arranged from the second surface to the connection surface in a direction crossing a projecting direction of the second surface.

A surface of the sealing material introduced into the recess is specified based on the second surface. Thus, even if the sealing material leaks out from the first surface to the second surface, the sealing material is trapped by the third surface and cannot reach the connection surface. Thus, it is not necessary to strictly manage the introduced amount of the sealing material and operability when introducing the sealing material is improved.

The second surface preferably serves as a jig contact surface and a jig for detecting an air leak in an introduced part of the sealing material can be held in contact with the second surface at a detection position. This construction is simpler than if a special jig contact surface is formed separately from the second surface.

The third surface preferably functions as a jig guiding surface and guides the jig to the detection position. This construction is simpler than if a special jig guiding surface is formed separately from the third surface.

The second and third surfaces preferably are sealing surfaces that keep a space to the jig air-tight at the detection position. This construction is simpler than if special sealing surfaces are formed separately from the second surface and the third surface.

Sealing material that leaks out from the recess may be trapped into at least one trap space defined by the second and third surfaces in the recess.

One or more ribs preferably project from the housing and can be inserted into the bulges of the mating housing when the two housings are connected properly. However, the ribs interfere with the mating housing and cannot enter the bulges if either of the housings is oriented improperly.

The invention also relates to a connector assembly comprising the above-described connector and a mating connector connectable therewith.

The connector preferably is connected to the mating connector by threadably engaging the nut with the bolt.

The mating connector preferably comprises a mating housing connectable to the housing. A seal is mounted in the mating housing and is sandwiched between the two housings to contact the two housings closely in a connected state.

The mating housing preferably has at least one catch. An end surface of the seal serves as a pressing surface and is pressed to push the seal to a mount position in the process of mounting the seal into the mating housing. The seal resiliently moves past the catch and engages the catch at the mount position.

The pressing surface of the seal preferably is arranged at a position overlapping the catch in a projecting direction of the catch when the seal is mounted into the mating housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
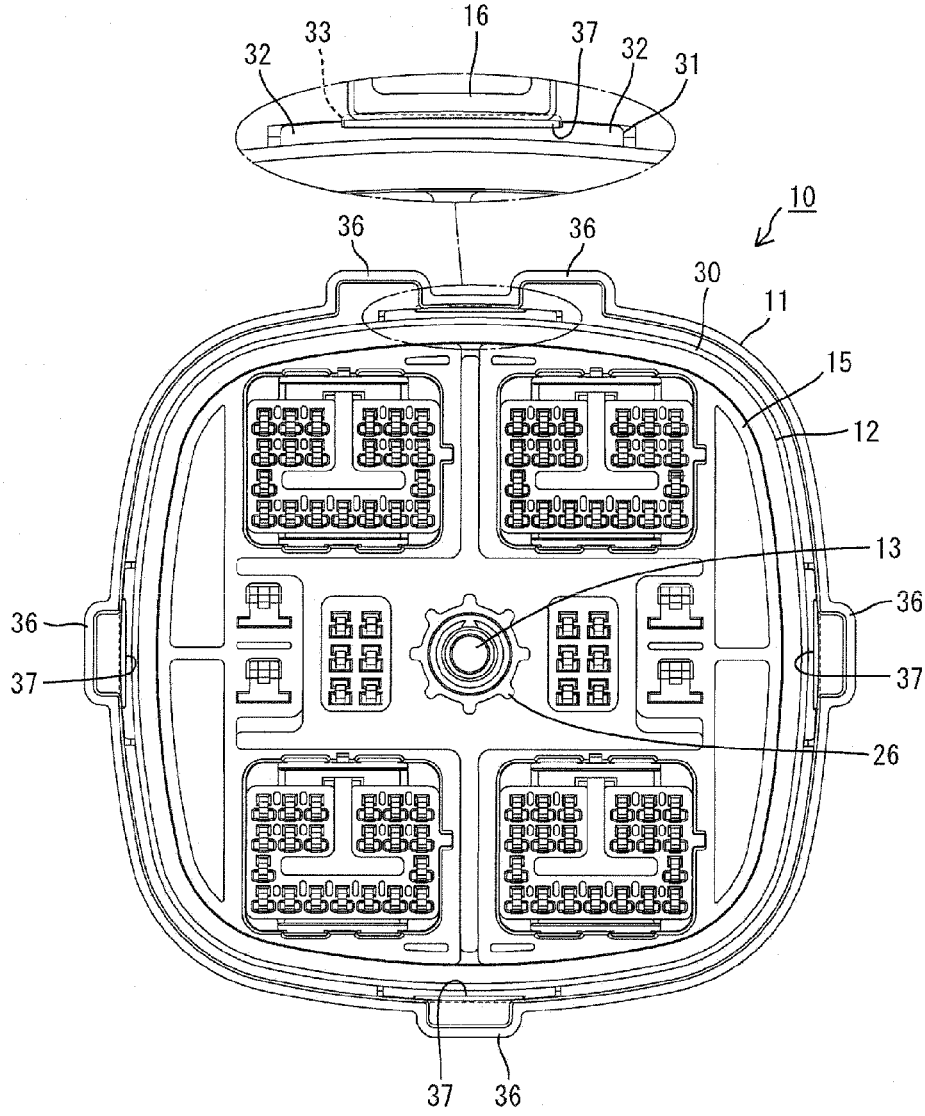
FIG. 1 is a front view of a female one of two connectors according to one embodiment of the invention.
Figure 2:
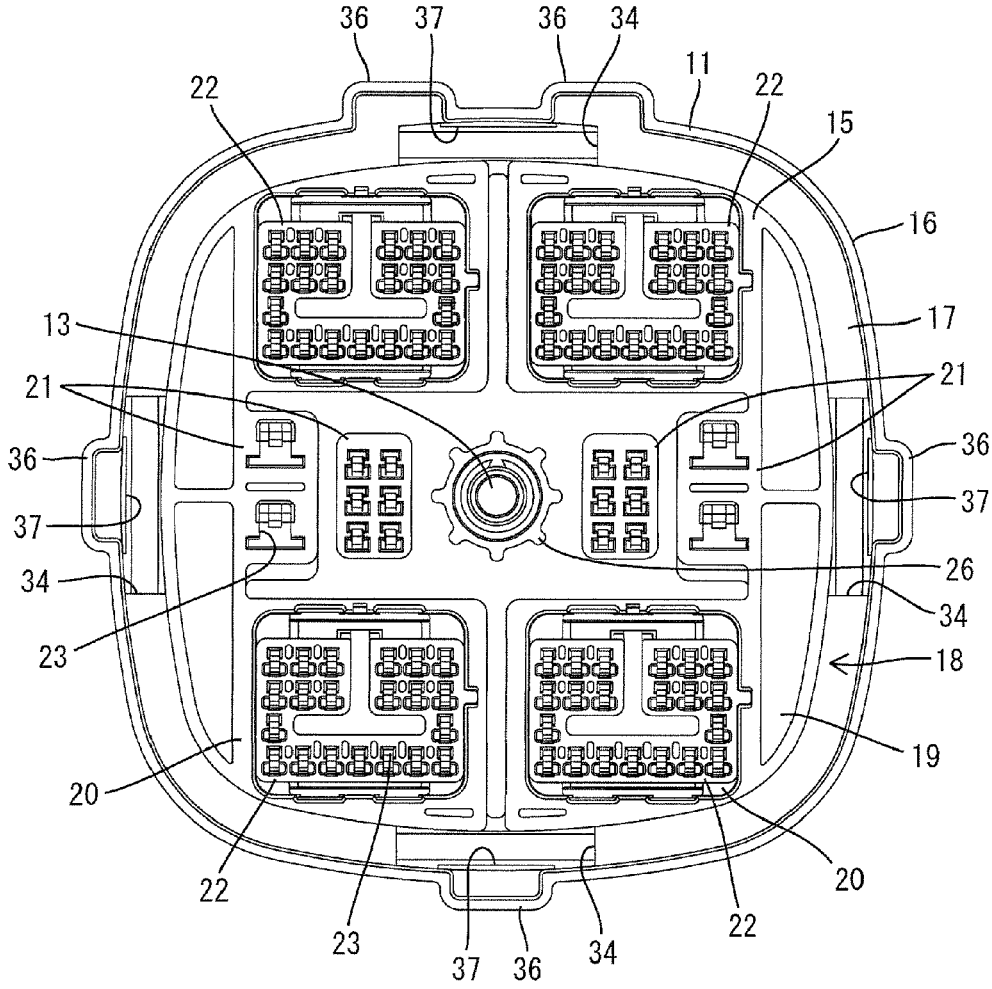
FIG. 2 is a front view of a female housing.

A connector assembly according to the invention includes female and male connectors 10, 50 connectable to each other. The female connector 10 includes a female housing 11, a seal 12, at least one bolt 13 and one or more female terminal fittings 14. The male connector 50 includes a male housing 51, at least one nut 52, a moving plate 53 and one or more male terminal fittings 54. In the following description, ends of the two connectors 10, 50 to be connected are referred to as front ends concerning forward and backward directions.

Figure 5:
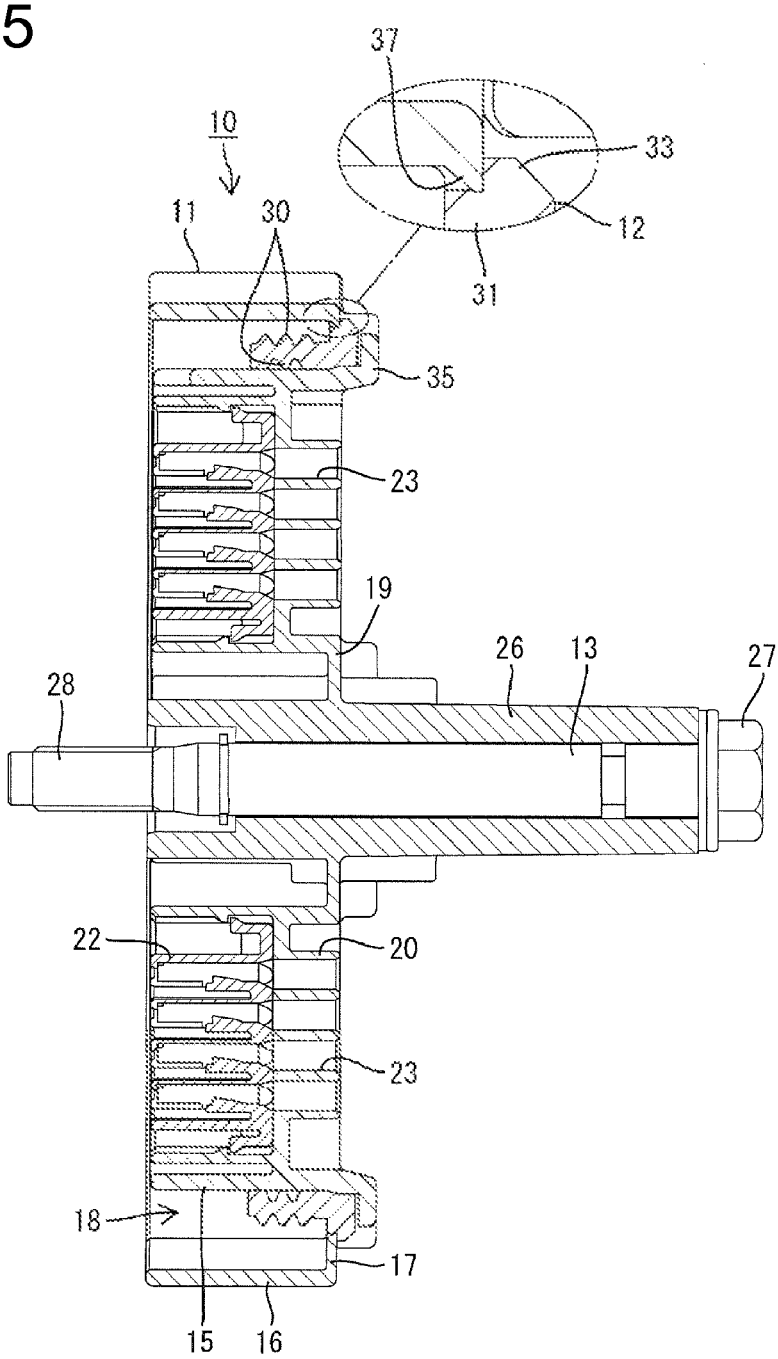
FIG. 5 is a section of the female connector.
Figure 6:
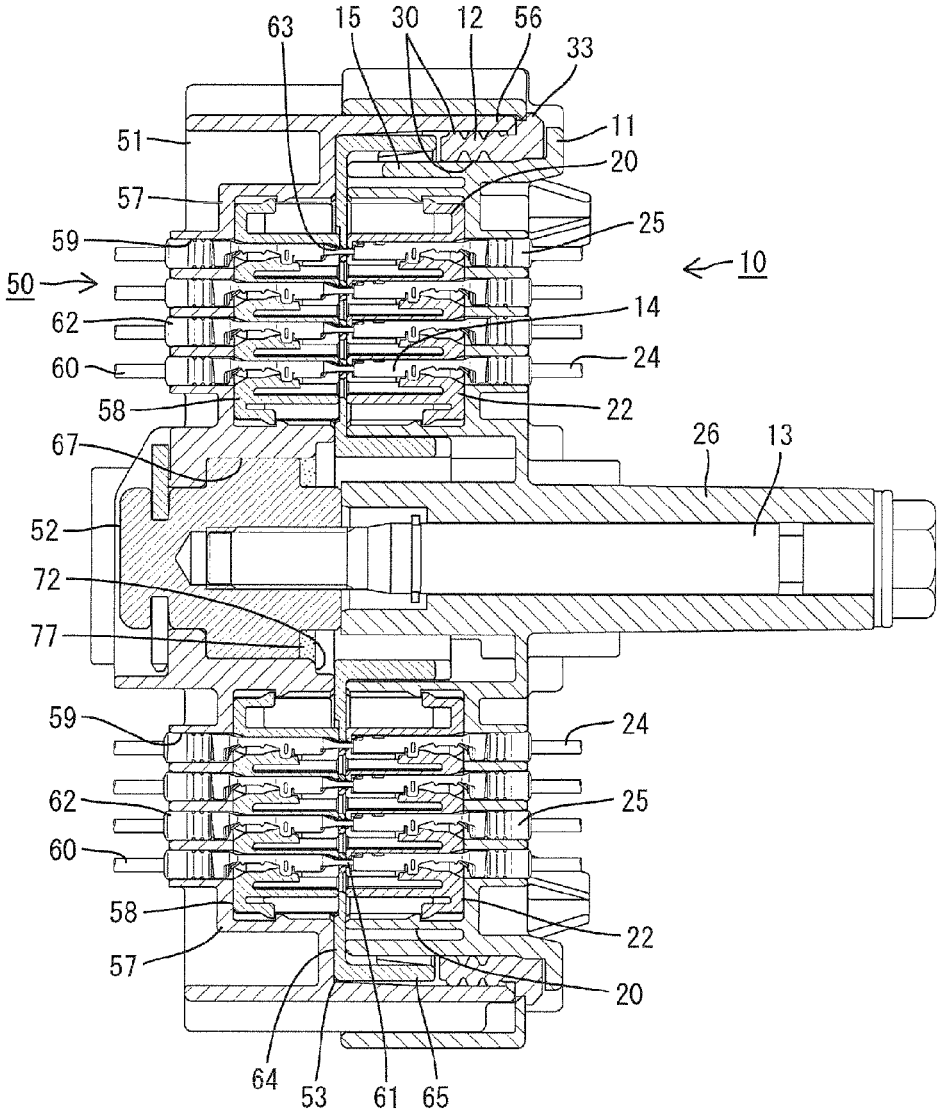
FIG. 6 is a section of the two connectors in a connected state.

The female housing 11 is made of synthetic resin and is substantially flat and short in forward and backward directions, as shown in FIGS. 5 and 6. The female housing 11 includes a housing main body 15 that is substantially rectangular in front view. An outer tube 16 at least partly surrounds the housing main body 15 while being spaced apart by a specified distance. A coupling 17 couples the rear ends of the housing main body 15 and the outer tube 16. A mounting space 18 is defined between the housing main body 15 and the outer tube 16 and can receive a receptacle 56 of the mating male housing 51.

The housing main body 15 includes a back plate 19 that extends substantially continuous from the coupling 17. Spaced apart female sub-housing accommodating portions 20 are formed in the back plate 19 and cavity towers 21 project forward from the back plate 19 between the respective female sub-housing accommodating portions 20. A corresponding female sub-housing 22 is fit in each female sub-housing accommodating portion 20. Female cavities 23 are formed in the cavity towers 21 and the female sub-housings 22, and the female terminal fittings 14 are retained in the respective female cavities 23. The female terminal fittings 14 are connected respectively to end portions of wires 24, and the connected wires 24 are drawn out backward from the rear surface of the housing main body 15 (see FIG. 6). A female rubber plug 25 is mounted on the outer peripheral surface of each wire 24 to closely contact this outer peripheral surface and the inner peripheral surface of the corresponding female cavity 23.

A bolt mounting portion 26 projects forward in a substantially central part of the back plate 19. The front ends of the bolt mounting portion 26, the cavity towers 21 and the female sub-housing accommodating portions 20 are aligned substantially at the same position, and a connection surface of the female housing 11 is formed by these front ends. The bolt mounting portion 26 includes a long and narrow cylindrical part projecting backward from the back plate 19. The bolt 13 is held rotatably in the bolt mounting portion 26. A head 27 of the bolt 13 is arranged to face the rear end opening of the bolt mounting portion 26, and a shaft 28 of the bolt 13 is arranged to project forward from the front end opening of the bolt mounting portion 26, i.e. from the connection surface.

Figure 3:
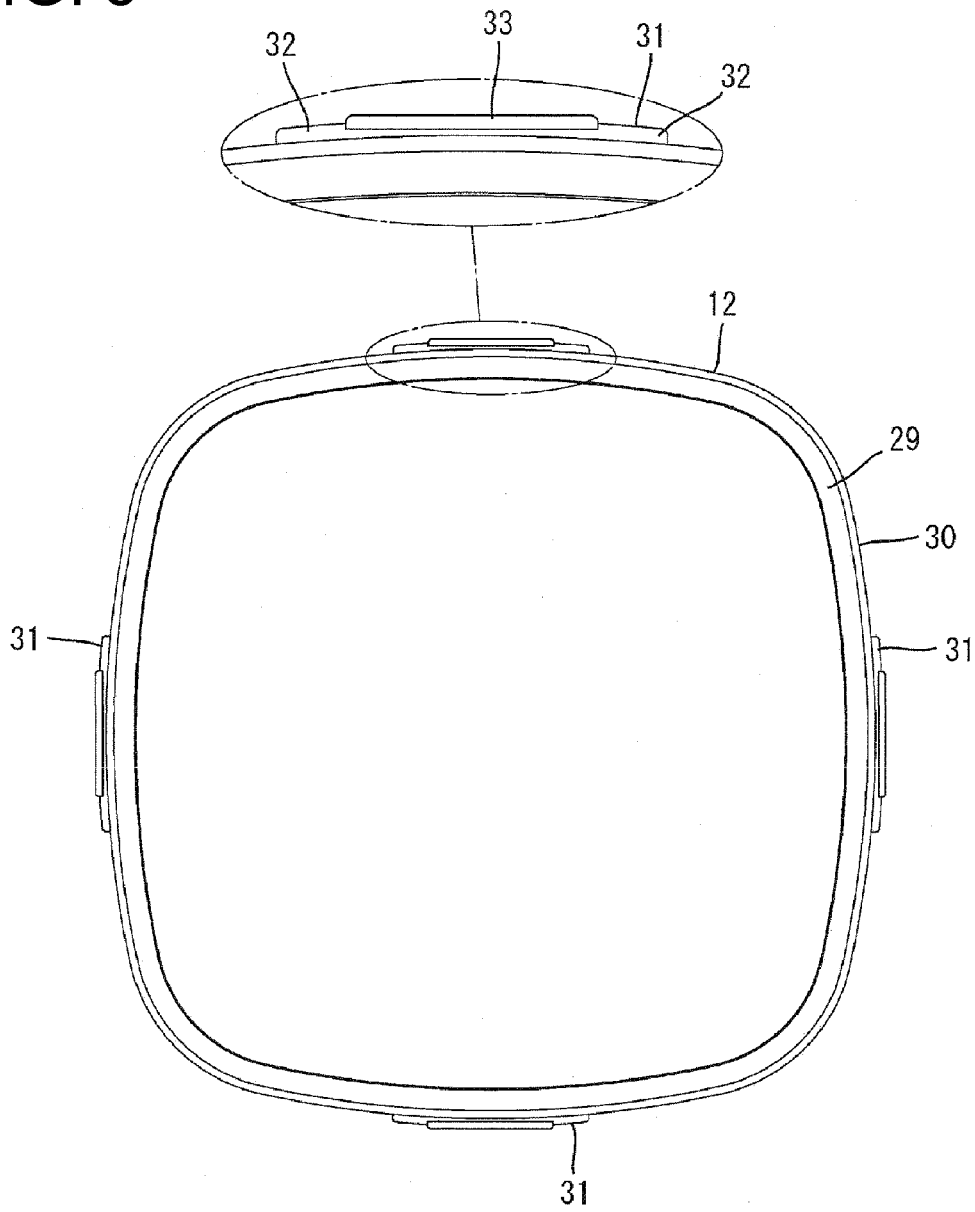
FIG. 3 is a front view of a seal member.

The seal 12 is made of a resilient material such as rubber and, as shown in FIG. 3, includes an annular seal main body 29 with four somewhat angular corners. The seal 12 is mounted into the female housing 11 so that the seal main body 29 is on the outer peripheral surface of the housing main body 15 and is inserted deeply into the mount space 18 to contact the coupling 17.

Lips 30 are formed on the inner and outer surfaces of the seal main body 29 and are spaced apart in forward and backward directions. The inner lips 30 are brought resiliently into close contact with the outer peripheral surface of the housing main body 15 and the outer lips 30 are brought resiliently into close contact with the inner peripheral surface of the mating receptacle 56 when the two housings 11, 51 are connected. As a result the space between the two housings 11, 51 is sealed in a fluid- or liquid-tight manner (see FIG. 6).

Flanges 31 that extend back from the seal main body 29 and then project out. The flanges 31 are long and narrow in a circumferential direction along the seal main body 29 and are arranged at substantially equal intervals in the circumferential direction. In this embodiment, four flanges 31 are arranged respectively at upper, lower, left and right positions spaced apart by 90°. The outer projecting ends of the respective flanges 31 are located farther out than the respective outer lips 30. The opposite ends of the front surface of each flange 31 in the circumferential direction define pressing surfaces 32 to be pressed by an unillustrated mounting jig when the seal 12 is mounted into the female housing 11.

A projection 33 projects radially at a position between the pressing surfaces 32 at the projecting end of each flange 31. This projection 33 is long and narrow along a central part of the projecting end of each flange 31 and is at a rear portion of the each flange 31.

The coupling 17 is formed with through holes 34 in the form of long narrow slits that extend in the circumferential direction at positions corresponding to the respective flanges 31, and receiving portions 35 project back from positions corresponding to the through holes 34. The receiving portions 35 are in the form of shallow boxes that are open outward. Rear parts of the respective flanges 31 are inserted into the receiving portions 35 and passed through the through holes 34. Thus, the rear parts of the respective flanges 31 including the projections 33 can be seen from the outside. Note that the seal 12 preferably has a color different from the housing main body 15 to ensure good visual discrimination between the seal 12 and the housing main body 15.

Circumferentially spaced bulges 36 project out on the outer tube 16 at positions substantially facing the respective flanges 31 of the seal main body 29 when the seal 12 is mounted into the female housing 11. Specifically, upper bulges 36 are arranged at positions substantially corresponding to the both pressing surfaces 32 of the upper flange 32, and lower, left and right bulges 36 are arranged at positions substantially corresponding to the lower, left and right projections 33.

Catches 37 project in at positions on the coupling 17 corresponding to the respective receiving portions 35 and partly close the through holes 34. The catches 37 engage the corresponding projections 33 when the seal 12 is mounted in the female housing 11 to prevent detachment of the seal 12 from the female housing 11. Each catch 37 has a circumferential length as long as the projections 33 or slightly shorter than the projections 33. Only the projections 33 of the seal 12 can be engaged with the catches 37. The upper catch 37 is arranged between the upper bulges 36 and the lower, left and right catches 37 are arranged in correspondence with the lower, left and right bulges 36.

Each catch 37 overlaps the pressing surfaces 32 of the corresponding flange 31 of the seal 12 in a radial projecting direction of the projection 33 when the seal 12 is mounted into the female housing 11. More specifically, both pressing surfaces 32 are arranged at the opposite sides of the catch 37 in the circumferential direction (see FIG. 1).

Figure 7:
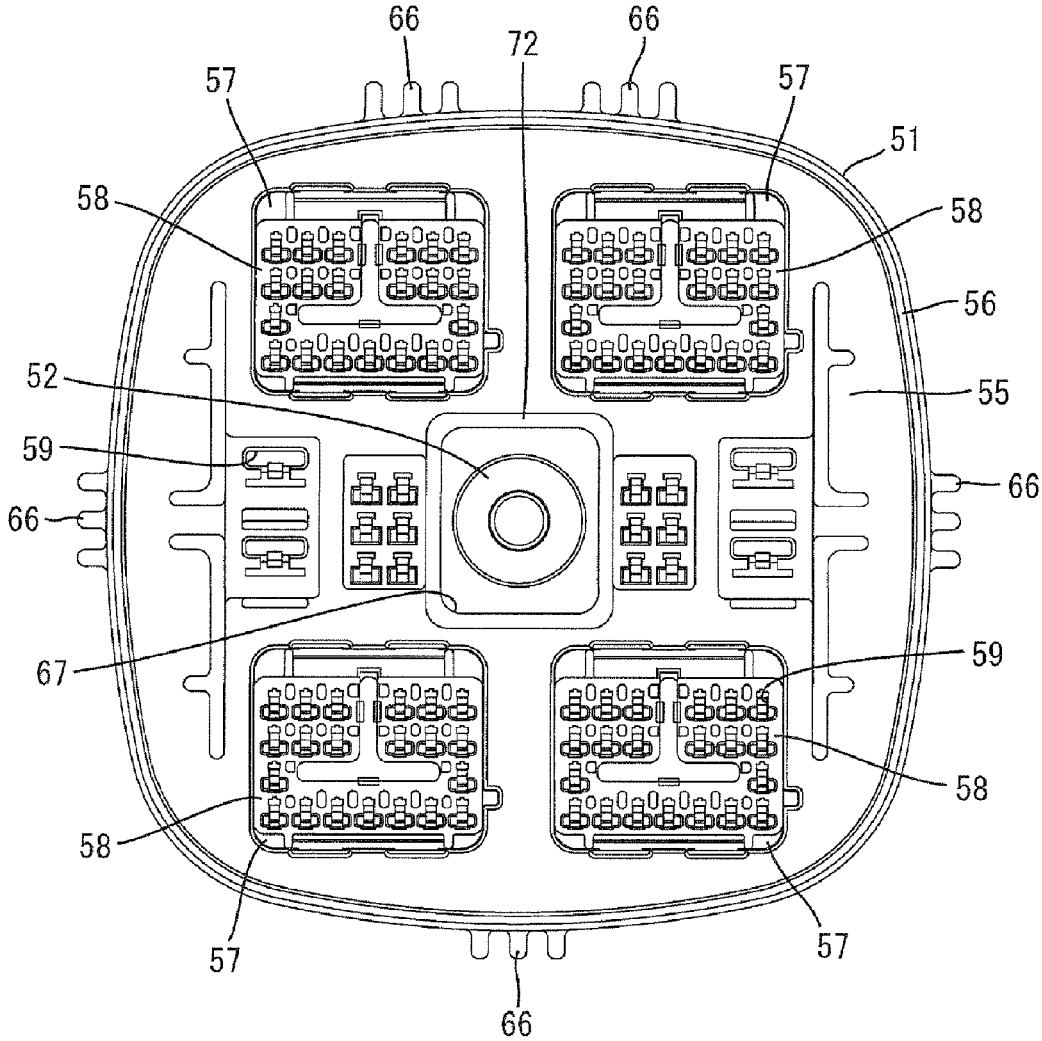
FIG. 7 is a front view of a male housing.

The male housing 51 is made e.g. of synthetic resin and, as shown in FIGS. 6 and 7, includes a terminal mounting portion 55 that is substantially flat and short in forward and backward directions and substantially rectangular in front view. A tube 56 projects forward from the peripheral edge of the terminal mounting portion 55. Circumferentially space male sub-housing accommodating portions 57 are formed in the terminal mounting portion 55 and corresponding male sub-housings 58 can be fit in the corresponding male sub-housing accommodating portions 57. The male sub-housings 58 are formed with male cavities 59, and the male terminal fittings 54 are held in the respective male cavities 59. The male terminal fittings 54 are connected to ends of wires 60 and the wires 60 are drawn out backward from the rear surface of the terminal mounting portion 55. Each male terminal fitting 54 includes a male tab 61 that projects into the receptacle 56. A male rubber plug 62 is mounted on the outer peripheral surface of each wire 60 to be held in close contact with the outer peripheral surface and the inner peripheral surface of the corresponding male cavity 59.

The moving plate 53 is to be inserted in the receptacle 56 and has a plate main body 64 formed with positioning holes 63 through which the respective male tabs 61 are inserted while being positioned. A peripheral wall 65 projects forward from the outer peripheral edge of the plate main body 64 and can slide in contact with the inner peripheral surface of the receptacle 56. The moving plate 53 is movable forward and backward between a standby position and a connection position in the receptacle 56. The male tabs 61 project only a small amount from the positioning holes 63 when the moving plate 53 is at the standby position. In the process of connecting the two housings 11, 51. The moving plate 53 is pushed by the mating female housing 11 to move from the standby position to the connection position. At the connection position, the male tabs 61 project more forward from the positioning holes 63 and are connected electrically conductively to the mating female terminal fittings 14. Further, the plate main body 64 is sandwiched between the front connection surfaces of the two housings 11, 51.

Circumferentially spaced ribs 66 project from the outer peripheral surface of the receptacle 56. The ribs 66 are inserted respectively into the bulges 36 of the mating female housing 11 when the two housings 11, 51 are connected properly, but interfere with the front edge of the outer tube 16 without being inserted into the bulges 36 when an attempt to connect the two housings 11, 51 is made with one housing inverted with respect to the other, thereby preventing an erroneous connection of the two housings 11, 51.

Figure 8:
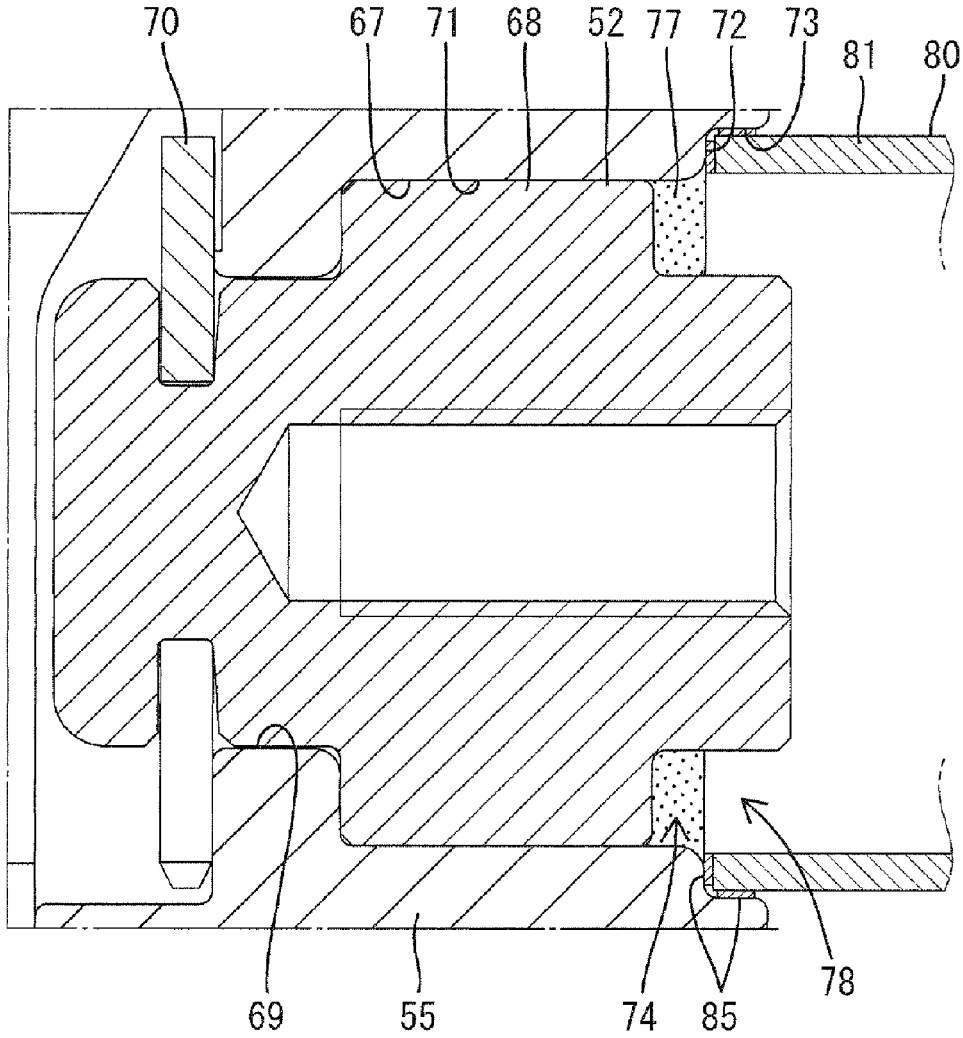
FIG. 8 is an enlarged section showing an essential part of the male housing.

A substantially rectangular recess 67 is formed in a central part of the front surface of the terminal mounting portion 55 and the nut 52 is fit in the recess 67. As shown in FIG. 8, the nut 52 has a cross-sectionally large portion 68 at a longitudinally intermediate position connected to front and rear parts of the nut 52 by steps. An insertion hole 69 is formed in a central part of the bottom surface of the recess 67 and penetrates from the bottom surface of the recess 67 to the rear surface of the terminal mounting portion 55. The cross-sectionally large portion 68 of the nut 52 is dimensioned to fit closely in an inner bottom part of the recess 67. Further, a rear end portion of the nut 52 projects from the insertion hole 69 and is fixed by a stopper 70 at the rear side of the terminal mounting portion 55.

The recess 67 is stepped to widen at an opening side. Specifically, the inner peripheral surface of the recess 67 has a first surface 71 that extends in forward and backward directions and closely contacts the cross-sectionally large portion 68 of the nut 52 and is arranged at a substantially constant distance from a front end portion of the nut 52. A second surface 72 is connected at a substantially at a right angle to the front end of the first surface 71 and extends out in a substantially radially direction away from the nut 52. A third surface 73 is connected at a substantially right angle to the outer end of the second surface 72 and extends from the outer end of the second surface 72 to the front connection surface of the terminal mounting portion 55 in forward and backward directions at a substantially right angle to the extending direction of the second surface 72. The second surface 72 is near the front surface of the terminal mounting portion 55 (opening edge of the recess 67).

A sealing material made of a potting material such as silicon resin is introduced into the recess 67 from the opening in the front surface. In this case, a space between the outer peripheral surface of the front end portion of the nut 52 and the first surface 71 of the recess 67 defines an introduction space 74 for the sealing material. The sealing material introduced into the introduction space 74 is coated or spread on the outer peripheral surface of the front end portion of the nut 52 and the first surface 71 of the recess 67. Thus, the nut 52 is sealed around in an air- or fluid-tight manner. The sealing material introduced into the introduction space 74 is cured, such as by being cooled, thereby forming a resin portion 77 in the recess 67.

The sealing material is introduced into the introduction space 74 of the recess 67. At this time, the sealing material is introduced using the position of the second surface 72 as an index so that the surface position thereof is substantially aligned with the second surface 72 in forward and backward directions. Any sealing material that leaks out from the introduction space 74 of the recess 67 is trapped in at least one trap space 78 defined by the second and third surfaces 72, 73 in the recess 67. Thus, the leaked sealing material will not reach the front surface of the terminal mounting portion 55.

An air leak test is carried out after the sealing material is cured to determine whether a sealed state in the recess 67 is proper. A jig 80 including a substantially cylindrical detector 81 is used for air leak test, and a leading end portion of the detector 81 is inserted into the recess 67. In an insertion process of the jig 80, the outer peripheral surface of the leading end portion of the detector 81 slides in contact with the third surface 73 of the recess 67 while being positioned. At a detection position where an inserting operation of the detector 80 is ended, an opening end surface of the detector 81 contacts the second surface 72 to prevent any further insertion of the jig 80. In other words, the second surface 72 of the recess 67 defines a jig contact surface with which the jig 80 can be held in contact at the detection position, and the third surface 73 of the recess 67 defines a jig guiding surface that can guide the jig 80 to the detection position. The jig 80 blows out air to the surface of the resin portion 77 from the detector 81 at the detection position and checks the sealed state based on the presence or absence of air leakage.

Seal materials 85 are attached to the outer peripheral surface of the leading end portion of the detector 81 and the opening end surface of the detector 81. The seal materials 85 are held in close contact with the second surface 72 and the third surface 73 at the detection position, thereby preventing air leakage between the second surface 72 and the third surface 73. In other words, the second surface 72 and the third surface 73 of the recess 67 also function as sealing surfaces for holding a space to the jig 80 air-tight at the detection position.

Figure 4:
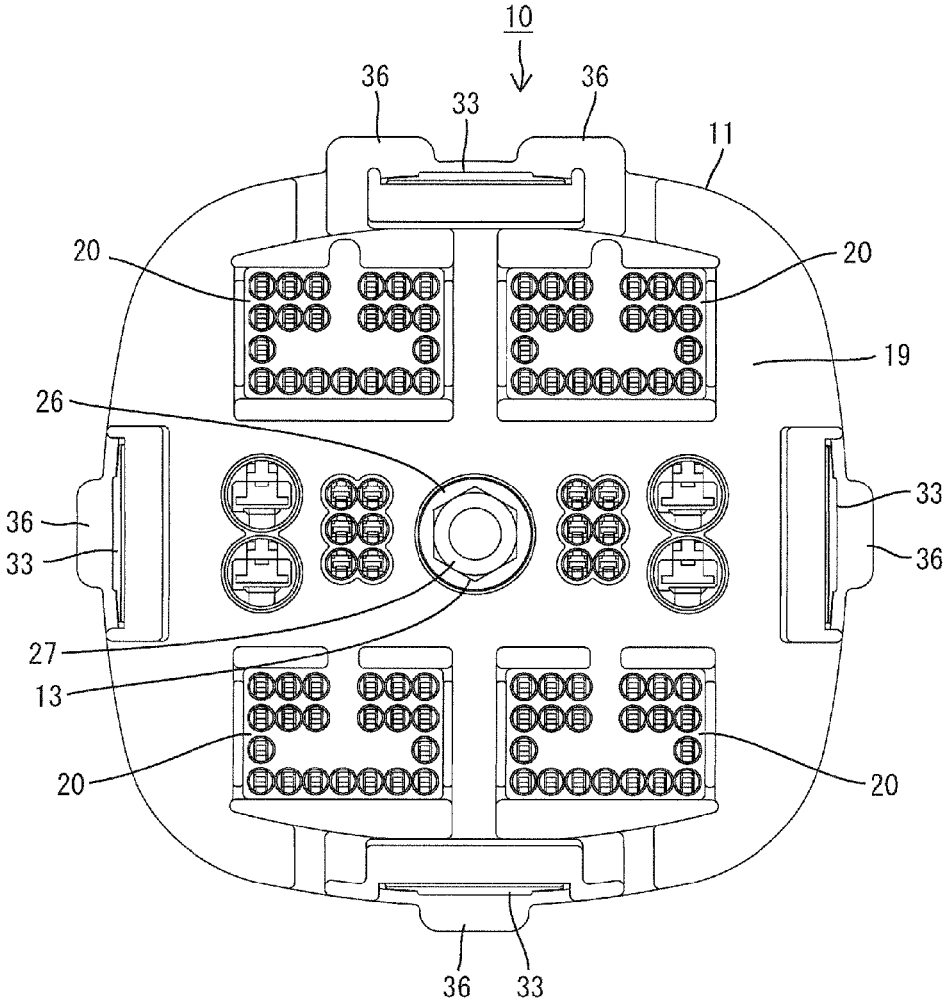
FIG. 4 is a rear view of the female housing.

On the other hand, the seal 12 is mounted on or to the housing main body 15 of the female housing 11. Upon mounting the seal 12 on the housing main body 15, a leading end portion of an unillustrated mounting jig is pressed against the pressing surfaces 32 of each flange 31 of the seal 12. The leading end portion of the mounting jig is substantially channel-shaped and includes two legs substantially facing the pressing surfaces 32. In this case, the leading ends of the legs press the pressing surfaces 32 while straddling the projection 33. Thus, the seal 12 is pushed toward the back side of the mount space 18. In the process of mounting the seal 12, the projections 33 interfere with the respective catching pieces 37 and resiliently deform the catching pieces 37 inwardly. As the seal 12 reaches a proper mount position, the projections 33 move past the catches 37 and restore resiliently. As a result, the projections 33 face the catches 37 from behind (see FIGS. 1 and 4). The seal 12 having reached the mount position in this way is prevented from coming out forward by the contact of the projections 33 with the catches 37 and are prevented from coming out backward by the contact of the seal 12 with the coupling 17.

Subsequently, upon starting a connecting operation of the two housings 11, 51, the two housings 11, 51 are arranged right opposite to each other and, in this state, the leading end of the shaft 28 of the bolt 13 is loosely screwed into the nut 52. The shaft 28 of the bolt 13 is screwed completely into the nut 52 and the two housings 11, 51 are connected to each other by this screwing operation. At this time, the head 27 of the bolt 13 is located behind and distant from the rear surface of the housing main body 15 by the bolt mounting portion 26. Thus, the wires 24 drawn out from the rear surface of the housing main body 15 are not tangled in a jig for tightening the bolt 13.

The surface position of the sealing material introduced into the recess 67 is based on the second surface 72. Thus, any sealing material that leaks out from the first surface 71 to the second surface 72 of the recess 67 is trapped by the third surface 73 of the recess 67 and will not reach the connection surface of the housing main body 15. Thus, it is not necessary to strictly manage the introduced amount of the sealing material and operability at the time of introducing the sealing material is improved.

The second surface 72 of the recess 67 is the jig contact surface with which the jig 80 for air leak test can be held in contact at the detection position. Thus, the construction can be simplified as compared with the case where a special jig contact surface is formed separately from the second surface 72.

The third surface 73 of the recess 67 serves as the jig guiding surface and guides the jig 80 to the detection position. Thus, the construction can be simplified as compared with the case where a jig guiding surface is formed separately from the third surface 73.

The second and third surfaces 72 and 73 of the recess 67 serve as the sealing surfaces to keep the space to the jig 80 fluid- or air-tight at the detection position. Thus, the construction can be simplified as compared with the case where special sealing surfaces are formed separately from the second surface 72 and the third surface 73.

The pressing surfaces 32 of the seal 12 are arranged at positions overlapping the respective catches 37 in the projecting directions of the catches 37 when the seal 12 is mounted into the female housing 11. Thus, the pressing surfaces 32 can be formed in sufficient spaces in the projecting directions of the catches 37. As a result, sufficient pressing areas of the pressing surfaces 32 of the seal 12 can be ensured without enlarging the female housing 11.

Two pressing surfaces 32 of the seal 12 are arranged at opposite sides of the catch 37 when the seal 12 is mounted into the female housing 11. Thus, the mounting jig for pressing the pressing surfaces 32 can have a channel shape to strengthen the jig.

The seal 12 has the projections 33 projecting in the same directions as the projecting directions of the catches 37 from parts adjacent to the pressing surfaces 32 and the projections 33 engage the catches 37. Thus, areas of engagement of the seal 12 with the catches 37 can be adjusted according to the projecting amounts of the projections 33.

The invention is not limited to the above described and illustrated embodiment. For example, the following embodiments are also included in the scope of the invention.

The catching pieces may be arranged in pairs and each pressing surface of the seal member may be positioned between the corresponding pair of catching pieces.

The second surface of the recess may not necessarily be orthogonal to the first and third surfaces.

Conversely to the above, a nut may be mounted in the female connector and a bolt may be mounted in the male connector.

What is claimed is:

1. A connector assembly, comprising:

a housing connectable to a mating housing and having at least one recess formed in a connection surface substantially facing the mating housing in a connected state; and at least one nut at least partly inserted into the recess, fixed to the housing in a state at least partly exposed on the connection surface, and threadably engaged with at least one bolt mounted in the mating housing to hold the two housings in the connected state;

wherein:

a sealing material at least partly is introduced into the recess and the outer peripheral surface of the nut is coated with the sealing material; and the recess of the housing includes:

a first surface arranged to substantially face the outer peripheral surface of the nut while forming an introduction space for the sealing material between itself and the outer peripheral surface of the nut, a second surface arranged to project radially outwardly from the first surface and a third surface arranged from the second surface to the connection surface in a direction crossing a projecting direction of the second surface.

2. The connector assembly of claim 1, wherein the second surface is a jig contact surface with which a jig for detecting air leak in an introduced part of the sealing material can be held in contact at a detection position.

3. The connector assembly of claim 2, wherein the third surface is a jig guiding surface that can guide the jig to the detection position.

4. The connector assembly of claim 2, wherein the second surface and the third surface are sealing surfaces which keep a space to the jig air-tight at the detection position.

5. The connector assembly of claim 1, wherein the second and third surfaces define at least one trap space in the recess for trapping any sealing material that leaks out from the recess.

6. The connector assembly of claim 1, wherein ribs project from the housing and are to be at least partly inserted into or engaged with the one or more bulging portions of the mating housing when the two housings are connected properly while interfering with the mating housing without being inserted into the bulging portions, thereby functioning to prevent an erroneous connection of the two housings, when it is attempted to connect the two housings in an improper relative orientation.

7. The connector assembly of claim 1, wherein the connector is connected to the mating connector by threadably engaging the nut with the bolt.

8. The connector assembly of claim 1, wherein the mating connector comprises a mating housing connectable to the housing, and a seal member to be mounted in the mating housing to be held in close contact with the two housings in a connected state by being sandwiched between the two housings.

9. A connector assembly according to claim 8, wherein the mating housing is formed with at least one catching piece, an end surface of the seal member serves as a pressing surface, and the pressing surface is pressed to push the seal member to a mount position in the process of mounting the seal member into the mating housing and the seal member resiliently moves past the catching piece and is engaged with the catching piece at the mount position.

10. The connector assembly of claim 9, wherein the pressing surface of the seal member is arranged at a position at least partly overlapping the catching piece in a projecting direction of the catching piece when the seal member is mounted into the mating housing.

* * * * *